US010378276B2

(12) United States Patent
Garcia Garcia

(10) Patent No.: US 10,378,276 B2
(45) Date of Patent: Aug. 13, 2019

(54) FASTENING SYSTEM FOR A DECORATIVE VALANCE OF A ROLLER BLIND AND A DECORATIVE VALANCE OF A CURTAIN PROVIDED WITH A FASTENING SYSTEM

(71) Applicant: Bandalux Industrial, S.A., Barcelona (ES)

(72) Inventor: Emiliano Garcia Garcia, Barcelona (ES)

(73) Assignee: Bandalux Industrial, S.A., Barcelona (ES)

( * ) Notice: Subject to any disclaimer, the term of this patent is extended or adjusted under 35 U.S.C. 154(b) by 0 days.

(21) Appl. No.: 15/447,217

(22) Filed: Mar. 2, 2017

(65) Prior Publication Data

US 2018/0252032 A1 Sep. 6, 2018

(51) Int. Cl.

| | |
|---|---|
| ***A47H 2/00*** | (2006.01) |
| ***E06B 9/42*** | (2006.01) |
| ***E06B 9/50*** | (2006.01) |

(52) U.S. Cl.

CPC . *E06B 9/42* (2013.01); *E06B 9/50* (2013.01)

(58) Field of Classification Search

CPC ..... E06B 9/50; E06B 9/42; E06B 9/72; E06B 9/1703; E06B 9/17; E06B 9/17007; E06B 9/17015; E06B 9/174; A47H 1/13; A47H 1/14; A47H 1/142; A47H 1/144; A47H 1/10; A47H 1/102; A47H 1/104

USPC ..... 160/323.1, 324, 325, 326; 248/261, 262, 248/264, 266, 267, 268

See application file for complete search history.

(56) References Cited

U.S. PATENT DOCUMENTS 1,476,160 A * 12/1923 Kirsch ..... E06B 9/50 160/23.1
2,549,905 A * 4/1951 Jablon ..... E06B 9/323 160/34
2,792,999 A * 5/1957 Lorentzen ..... E06B 9/323 248/264
3,372,728 A * 3/1968 Schaefer ..... A47H 2/02 160/39
4,270,720 A * 6/1981 Fukuchi ..... A47H 1/142 248/257
4,352,433 A * 10/1982 Ford ..... A47H 1/122 211/105.1
4,492,261 A * 1/1985 Chong ..... E06B 9/78 160/319
4,824,062 A * 4/1989 Wagner ..... A47H 1/122 16/94 R
4,828,002 A * 5/1989 Ashby ..... E06B 9/323 160/21
5,330,821 A * 7/1994 Lo ..... A47H 2/02 16/94 R (Continued)

*Primary Examiner* — Johnnie A. Shablack

(57) ABSTRACT

A fastening system for a decorative valance of a roller shade and/or blind, in which the decorative valance is comprised of a front panel and side panels, defining an inner housing, a housing in which there is a rotating roller to which a band of the roller shade is coupled, the rotating roller being connected to drive means that act on the rotating roller. This fastening system comprises an anchoring element that has a first coupling region configured to be coupled to a wall or ceiling, a second region provided with coupling means provided for supporting the drive means of the rotating roller, and guide means configured to attach one of the side panels of the decorative valance.

11 Claims, 5 Drawing Sheets

(56) References Cited

U.S. PATENT DOCUMENTS 6,935,401 B2 * 8/2005 Fraczek ..... E06B 9/50 160/321
7,857,034 B2 * 12/2010 Chou ..... E06B 9/50 160/323.1
7,900,680 B2 * 3/2011 Garmyn ..... E06B 9/42 160/23.1
8,480,048 B2 * 7/2013 Krantz-Lilienthal ... F16B 2/245 160/23.1
8,608,126 B2 * 12/2013 Ng ..... E06B 9/50 160/323.1
8,820,386 B2 * 9/2014 Mullet ..... E06B 9/40 160/133
8,960,621 B2 * 2/2015 Wills ..... F16B 5/0614 160/19
8,967,227 B2 * 3/2015 Chou ..... A47H 1/14 160/23.1
8,967,568 B2 * 3/2015 Wills ..... E06B 9/50 160/323.1
9,010,706 B2 * 4/2015 Cheng ..... A47H 99/00 248/261
9,060,636 B2 * 6/2015 Cannaverde ..... E06B 9/174
9,062,493 B2 * 6/2015 Marocco ..... E06B 9/40
9,062,494 B2 * 6/2015 Chen ..... E06B 9/60
D740,589 S * 10/2015 Ng ..... D6/580
D753,933 S * 4/2016 Ng ..... D6/580
9,303,707 B2 * 4/2016 Fraczek ..... F16D 67/02
9,410,369 B2 * 8/2016 Mullet ..... H02P 3/08
9,617,785 B2 * 4/2017 Chou ..... E06B 9/24
9,890,585 B2 * 2/2018 Mullet ..... E06B 9/42
2003/0051830 A1 * 3/2003 Garcia Garcia ..... E06B 9/42 160/323.1
2005/0205216 A1 * 9/2005 Vrielink ..... E06B 9/323 160/23.1
2006/0289126 A1 * 12/2006 Kollman ..... B65D 59/02 160/178.1 R
2008/0289775 A1 * 11/2008 Lukos ..... E04F 10/0662 160/242
2009/0014134 A1 * 1/2009 Hanley ..... E06B 9/42 160/266
2009/0126881 A1 * 5/2009 Chi ..... A47H 2/00 160/368.1
2010/0219306 A1 * 9/2010 Detmer ..... E06B 9/72 248/201
2010/0236730 A1 * 9/2010 Koop ..... E06B 9/50 160/323.1
2011/0132556 A1 * 6/2011 Kao ..... E06B 9/42 160/368.1
2011/0139381 A1 * 6/2011 Daniels ..... E06B 9/50 160/298
2012/0160975 A1 * 6/2012 Cannaverde ..... E06B 9/174 248/208
2013/0068398 A1 * 3/2013 Wills ..... E06B 9/42 160/26
2013/0192773 A1 * 8/2013 Wills ..... E06B 9/42 160/323.1
2013/0319624 A1 * 12/2013 Cannaverde ..... E06B 9/174 160/405
2014/0251558 A1 * 9/2014 Chou ..... E06B 9/42 160/323.1
2014/0299729 A1 * 10/2014 Wills ..... E06B 9/50 248/254
2014/0352897 A1 * 12/2014 Mullet ..... E06B 9/42 160/323.1
2015/0007949 A1 * 1/2015 Daniels ..... E06B 9/50 160/323.1
2015/0047795 A1 * 2/2015 Bohlen ..... E06B 9/62 160/316
2015/0083351 A1 * 3/2015 Campagna ..... E06B 9/50 160/310
2015/0297014 A1 * 10/2015 Cannaverde ..... E06B 9/174 248/558
2015/0300085 A1 * 10/2015 Klein Tuente ..... A47H 1/142 248/267
2015/0322715 A1 * 11/2015 Chou ..... E06B 9/24 160/321
2015/0354273 A1 * 12/2015 Bohlen ..... E06B 9/50 160/323.1
2016/0083998 A1 * 3/2016 Grutzner ..... E06B 9/44 160/238
2016/0123076 A1 * 5/2016 Kirby ..... E06B 9/72 160/10
2016/0208552 A1 * 7/2016 Geiger ..... A47H 1/13
2016/0340972 A1 * 11/2016 Chou ..... E06B 9/24
2017/0022758 A1 * 1/2017 Nurre ..... E06B 9/42
2017/0058600 A1 * 3/2017 Mocanu ..... E06B 9/42
2017/0079459 A1 * 3/2017 Filko ..... A47H 1/122
2017/0081916 A1 * 3/2017 Greening ..... E06B 9/72
2017/0204660 A1 * 7/2017 Lu ..... E06B 9/581
2017/0247943 A1 * 8/2017 Ng ..... E06B 9/42
2017/0362892 A1 * 12/2017 Marzilli ..... E06B 9/72
2018/0023340 A1 * 1/2018 Goldberg ..... E06B 9/56
2018/0087319 A1 * 3/2018 McPherson ..... E06B 9/42
2018/0179812 A1 * 6/2018 Dubina ..... E06B 9/42

* cited by examiner

FASTENING SYSTEM FOR A DECORATIVE VALANCE OF A ROLLER BLIND AND A DECORATIVE VALANCE OF A CURTAIN PROVIDED WITH A FASTENING SYSTEM

OBJECT OF THE INVENTION

The object of the present invention is to provide a fastening system for a decorative valance of a roller blind.

More specifically, the invention proposes the development of a fastening system for a decorative valance of a shade and/or blind that is easy to manufacture and install, particularly provided for a decorative valance comprising a front panel and side panels, defining an inner housing, a housing in which there is a rotating roller connected to a band of the roller shade, the roller being connected to drive means that act on the rotating roller, that being provided with an anchoring element that simultaneously attaches the roller and the decorative valance to a wall or ceiling without additional attachment elements.

FIELD AND BACKGROUND OF THE INVENTION

Currently, there are known to be various assembly and fastening systems provided for attaching a box or decorative valance of a roller shade to a wall or ceiling of a facility, inside of which there are mechanisms for driving a rotating roller that incorporates the shade itself. An example of a decorative shade valance is described in the Spanish patent application no. ES 2350774, U.S. Pat. Nos. 9,062,493 or U.S. Pat. No. 8,820,386. All these systems are similar in that they require different pieces to independently join the drawer or decorative valance to the side wall or ceiling, as well as additional means to couple the roller to the decorative valance.

Nevertheless, since the known fastening systems use a large number of pieces and components to attach each one of the parts that form part of the assembly of the roller shade or blind, the manufacturing costs increase when a greater number of molds and equipment must be used to manufacture those pieces. Furthermore, another disadvantage, due to the high number of elements involved in attachment, is the fact that it is difficult for an installer to mount the assembly of the roller shade on the wall or ceiling and, therefore, the installation tasks are more cumbersome, thus implying a longer assembly time.

DESCRIPTION OF THE INVENTION

The present invention has been developed with the aim of providing a fastening system that constitutes a novelty within the field of application, and solves the disadvantages mentioned above while also contributing other additional advantages, which will become evident from the description provided below.

Therefore, an object of the present invention is to provide a fastening system for a decorative valance of a roller blind, particularly provided for a decorative valance comprising a front panel and side panels, defining an inner housing, inside which there is a rotating roller to which a band of the roller shade or blind is coupled, the roller being connected to drive means that act on the rotating roller.

In particular, the invention is characterized in that it comprises an anchoring element that has a first coupling region configured to couple to a wall or ceiling, a second region provided with coupling means provided for supporting the drive means of the rotating roller, and guide means configured to attach one of the side panels of the decorative valance.

Thanks to these characteristics, it is possible to reduce the number of pieces that form part of a decorative valance of a roller shade, since the anchoring element has a dual function: on one hand, it supports the decorative valance of the roller shade on the wall or ceiling, and the other hand, it supports the rotating roller located inside the decorative valance. This way, it is easier for an installer to assemble the decorative valance, thus reducing the assembly time.

Another equally important advantage of the system of the invention is that it allows the decorative valance of a roller blind to be attached to a wall or the ceiling, which implies that it does not use different pieces depending on the final location of the decorative shade valance.

According to another aspect of the invention, in which the anchoring element is made up of a laminar body with a central axis of symmetry that defines two symmetrical parts identical to each other, which has a first flap upon which the first region is arranged, and a second flap, folded at a right angle with respect to the first flap, upon which the second region and the fastening means are arranged.

This constructive design of the anchoring element allows the drive means (driven by a motor or a chain) of the roller shade to be arranged interchangeably on the right or left side of the decorative valance, therefore being a system with a greater degree of versatility.

Particularly, the first region has at least one through hole configured for the passage of screw elements provided for attachment to the wall or ceiling.

Advantageously, the through hole is a slotted hole, such that this design allows the installer or assembler to easily and quickly adjust the position of the decorative valance once the screws or pins are partially inserted into a hole made in the wall or ceiling.

In a particularly preferred embodiment, the first region comprises a pair of through holes separated from each other.

According to another characteristic of the fastening system, the second flap, where the second region is arranged, has a through hole on one of its faces, around which a plurality of tabs distributed radially around the through hole project outwards.

Preferably, the guide means comprise protrusions that project from each one of the sides of the second flap, said protrusions being configured to couple to the rails present on the inner face of the side panels of the decorative valance.

Additionally, there are gripping means located in the second region which are configured to keep the element firmly attached to the side panel of the decorative valance.

In an embodiment of the invention, the aforementioned gripping means can comprise screws that pass through corresponding through holes that are located on the second flap of the anchoring element, those through holes being located at the corners.

Preferably, the anchoring element is made from a metal material which provides good mechanical characteristic of resistance and strength.

Another object of the invention is to provide a decorative shade valance that comprises a front panel, a pair of side panels joined by means of the front panel, defining an inner housing, a housing in which there is a rotating roller to which the roller shade is coupled, the roller being connected to drive means that act on the rotating roller, wherein it comprises a pair of fastening systems, as above explained, which are arranged on opposite ends of the decorative valance.

Other characteristics and advantages of the fastening system, object of the present invention, will become clear in light of the description of a preferred, though non-exclusive, embodiment, which, by way of a non-limiting example, is illustrated in the accompanying drawings, wherein:

DESCRIPTION OF SPECIFIC EMBODIMENTS OF THE INVENTION

In view of the aforementioned figures and, in accordance with the numbering adopted, an example of a preferred embodiment of the invention can be observed therein, which comprises the parts and elements indicated and described in detail below.

Figure 1:
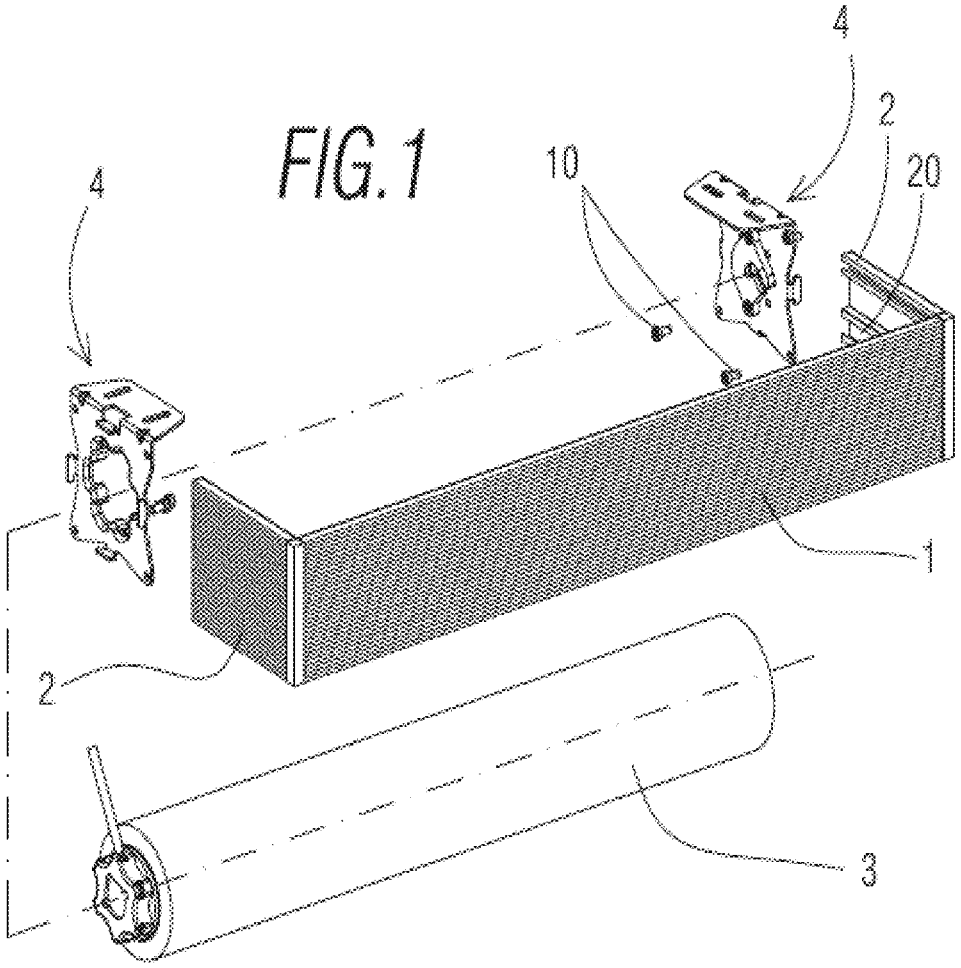
FIG. 1 shows an exploded perspective view of a decorative valance of a roller blind provided for the fastening system according to the present invention.
Figure 2:
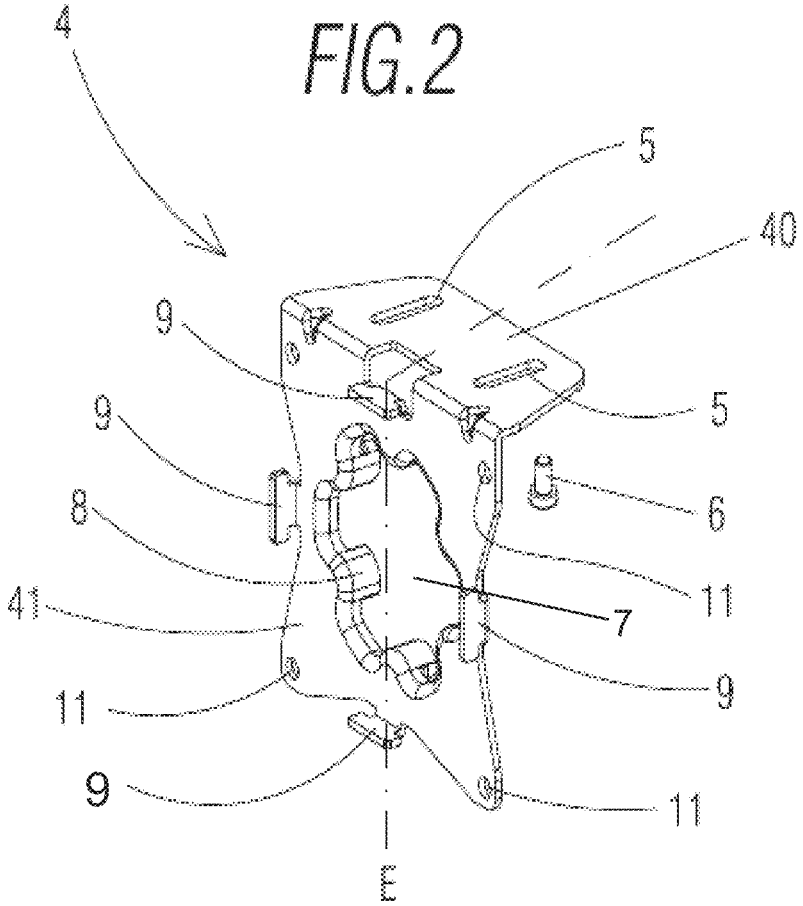
FIG. 2 shows a rear perspective view of a first embodiment of an anchoring element that forms part of the fastening system.

FIG. 1 schematically shows a decorative shade valance that is provided with a pair of fastening systems located on two ends facing each other. The decorative valance is comprised of a front panel 1 of a rectangular shape, a pair of side panels facing each other 2 and joined to the front panel 1, the front panel 1 and the side panels 2, defining an inner housing, a housing in which there is a rotating roller 3 (driven manually or by a motor) to which the band of roller shade or blind is coupled.

Each one of the fastening systems comprises an anchoring element, indicated generally with the reference 4, which has a first coupling region configured to be coupled to a wall or ceiling, a second region provided with coupling means provided for supporting the drive means of the rotating roller 3, and guide means (that are described further on) which are configured to attach one of the side panels of the decorative valance. In the present exemplary embodiment, the anchoring elements 4 are turned such that they attach to a ceiling.

Specifically, the anchoring element 4 is made up of a perforated laminar body defined by a central axis of symmetry E that defines two equal parts, symmetrical to each other, made from a metal material, a first flap 40 having an essentially square shape upon which the first region is arranged and a second flap 41 with an essentially rectangular shape, being folded at a right angle with respect to the first flap 40. The second region, as well as the fastening means, are arranged on this second flap 41. It is worth mentioning that in general the first flap 40 has small dimensions with respect to the second flap 41 of the laminar body. The fact that the anchoring element 4 has two equal, symmetrical parts allows that anchoring element 4 to attach to a ceiling or a wall.

In particular reference to the first region, it has at least one pair of slotted through holes 5 separated from each other that are configured to allow the passage of corresponding screw elements 6, which are provided for attachment to holes made in the wall or ceiling.

It can be seen how the second flap 41, wherein the second region is arranged, has a through hole 7 on one of its faces, around which a plurality of tabs 8 distributed radially around that through hole 7 project outwards. This hole 7 is provided to couple with an end of the rotating roller 3.

Figure 4:
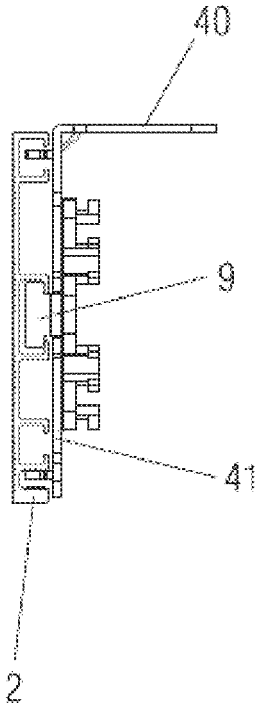
FIG. 4 shows a front elevation view of a segment of a side panel of the decorative valance, provided with the anchoring element.
Figure 5:
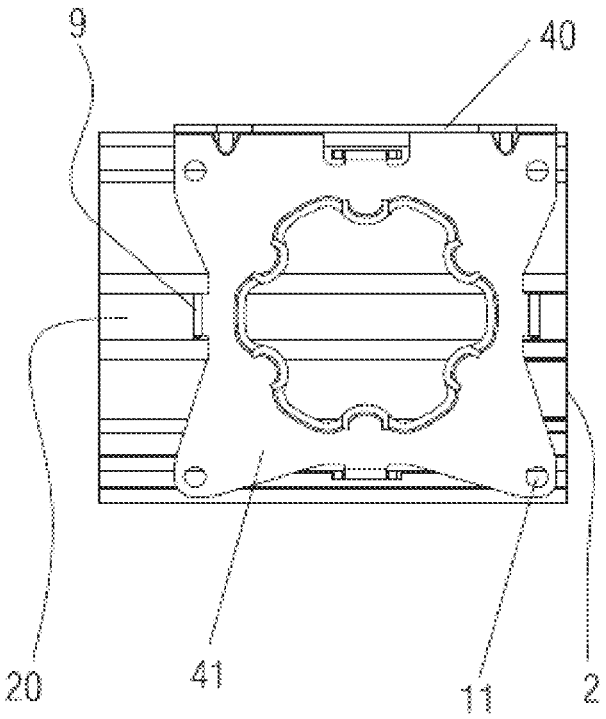
FIG. 5 shows a side elevation view of the segment of the side panel with the anchoring element.

With regards to the guide means, they comprise four protrusions 9 in a "T" shape that project from a plane perpendicular to each one of the sides of the second flap 41 of the anchoring element 4, said protrusions 9 being configured to couple to guides 20 arranged longitudinally along the inner face of each one of the side panels 2 of the decorative valance (see FIGS. 1, 4 and 5).

Figure 3:
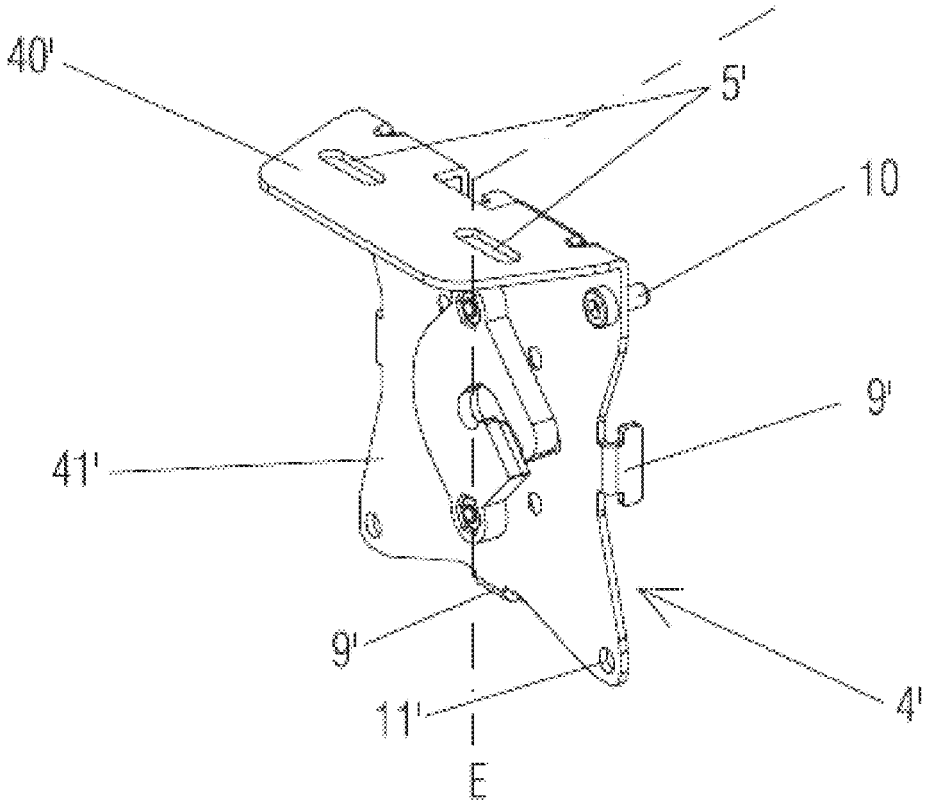
FIG. 3 shows a front perspective view of a second embodiment of the anchoring element.

FIG. 3 shows a second variation of the anchoring element 4' being anchoring element 4' made up of a perforated laminar body defined by a central axis of symmetry E that defines two equal parts, symmetrical to each other, made from a metal material, a first flap 40' having an essentially square shape upon which the first region is arranged and a second flap 41'. Said second flap 41' is essentially different from the second flap 41 of FIG. 1 in that it lacks the hole 7, wherein an accessory to couple to the opposite end of the rotating roller 3 is included. Also, it has one pair of slotted through holes 5' separated from each other and protrusions 9' configured to couple to guides 20 arranged longitudinally along the inner face of each one of the side panels 2.

Furthermore, the fastening system is provided with gripping means located in the second region which are configured to keep the anchoring element 4 attached to the side panel of the decorative valance. These gripping means essentially comprise screws 10 that pass through the respective through holes 11, 11' (see FIG. 3) located on the second flap 41, the through holes 11, 11' being located on each one of the corners of that second flap 41.

Figure 6:
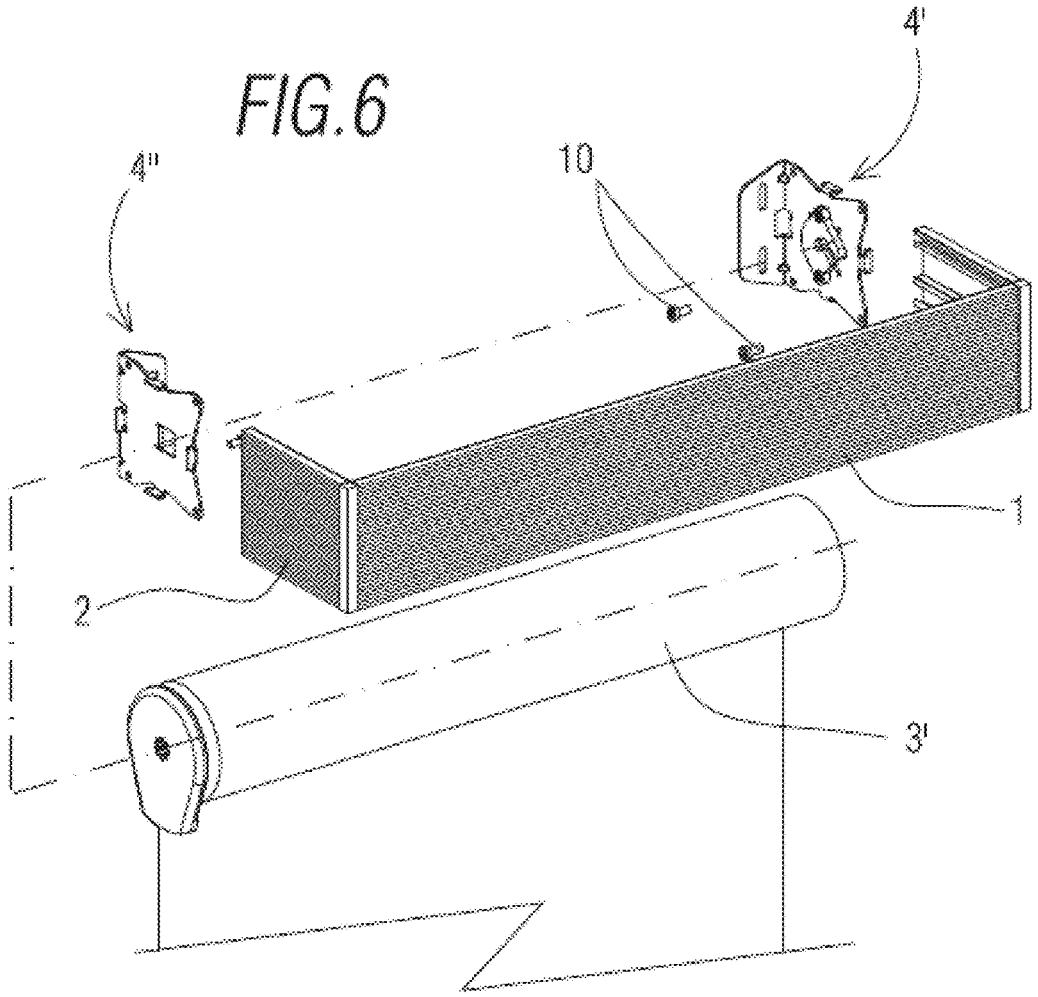
FIG. 6 shows an exploded schematic perspective view of a second embodiment of a roller shade assembly with the fastening system of the invention, wherein the rotating roller is driven without a motor, such that it is driven manually.

Finally, FIG. 6 shows a second assembly of a roller shade that comprises a rotating roller 3' located inside the decorative valance, wherein each one of its two ends are supported by means of an anchoring element 4', 4". Each one of the anchoring elements 4', 4" also support a respective side panel 2 and they are turned in order to be attached to a vertical wall, unlike the assembly shown in FIG. 1. In this exemplary embodiment, the rotating roller 3' is designed to be driven by chain.

What is claimed is:

1. A fastening system for a decorative valance of a roller blind, in which the decorative valance is comprised of a front panel and side panels, defining an inner housing, inside which there is a rotating roller to which a band of the roller shade is coupled, the rotating roller being connected to a chain that acts on the rotating roller, the fastening system comprising:

an anchoring element that has a first coupling region configured to be coupled to a wall or ceiling; and a second region provided with coupling means provided for supporting the chain of the rotating roller and guide means configured to attach one of the side panels of the decorative valance, wherein the anchoring element is made up of a laminar body with a central axis of symmetry that defines two symmetrical parts identical to each other, which has a first flap upon which the first region is arranged, and a second flap, folded at a right angle with respect to the first flap, upon which the second region and the coupling means and guide means are arranged;

wherein the guide means comprise protrusions that project from each one of the sides of the second flap in a direction opposite to a direction the first flap extends from the second flap, said protrusions being configured to couple to guides arranged longitudinally on an inner face of said one of the side panels of the decorative valance;

and wherein there are gripping means located in the second region which are configured to keep the anchoring element attached to the side panel of the decorative valance, the gripping means comprising screws that pass through through holes located on the second flap, the through holes being located on corners of the second flap.

2. The fastening system according to claim 1, wherein the first region has at least one through hole configured for the passage of screw elements provided for attachment to the wall or ceiling.

3. The fastening system according to claim 2, wherein the at least one through hole of the first region is a slotted hole.

4. The fastening system according to claim 1, wherein the first region comprises a pair of through holes separated from each other.

5. The fastening system according to claim 1, wherein the second flap, where the second region is arranged, has a central through hole on one of its faces, around which a plurality of tabs distributed radially around the central through hole project outwards.

6. The fastening system according to claim 1, wherein the anchoring element is made up of a metal material.

7. The fastening system of claim 1, wherein the protrusions are configured to couple to the guides by being releasably inserted therethrough.

8. The fastening system of claim 1, wherein the gripping means are configured to keep the anchoring element attached to the inner face of the side panel of the decorative valance, without perforating an outer face of the side panel of the decorative valance.

9. An assembly comprising:

a decorative shade valance that comprises a front panel and side panels, defining an inner housing, inside which there is a rotating roller to which a roller shade is coupled, the rotating roller being connected to a chain that acts on the rotating roller;

and a pair of fastening systems, according to claim 1, which are arranged on opposite ends of the decorative shade valance.

10. The assembly of claim 9, further comprising guides arranged longitudinally on inner faces of the side panels of the decorative shade valance.

11. The assembly of claim 10, wherein the guides comprise a plurality of longitudinally arranged guides defining a plurality of parallel recesses therein, and the protrusions comprise a plurality of protrusions that are releasably insertable into each of the plurality of parallel recesses.

* * * * *